United States Patent [19]

Long

[11] 3,951,405

[45] Apr. 20, 1976

[54] ROD SUPPORTED YIELDABLE BALL ENGAGING MEMBER FOR ENGAGING AND CLAMPING A POST SUPPORTED BALL

[76] Inventor: Ben Long, 4911 Brooklyn Blvd., Minneapolis, Minn. 55429

[22] Filed: Jan. 30, 1975

[21] Appl. No.: 545,729

[52] U.S. Cl. ..... 273/1 R; 273/DIG. 12; 43/18 GF

[51] Int. Cl.[2] ..... A63B 67/10

[58] Field of Search ..... 273/1 R, 26 R, 26 E, 273/29 A, 95 A, 140, 32 F, 32 R, 32 A; 294/86.32, 86.31, 99, 19 A; 63/DIG. 3; 43/17.2, 5, 18 GF

[56] References Cited

UNITED STATES PATENTS

| | | | |
|---|---|---|---|
| 1,696,817 | 12/1928 | St. John | 294/19 A |
| 2,557,789 | 6/1951 | Lamka | 273/140 |
| 2,801,875 | 8/1957 | McEvoy | 273/162 E X |
| 3,203,700 | 8/1965 | Antonious | 273/32 A |
| 3,797,156 | 3/1974 | Telech | 43/5 |

*Primary Examiner*—Richard C. Pinkham
*Assistant Examiner*—William R. Browne
*Attorney, Agent, or Firm*—Williamson, Bains & Moore

[57] ABSTRACT

A toy or game device is comprised of a ball which is supported on a small upright post or pylon. An elongate rod is provided with a flexible line which in turn is connected to a generally cylindrical ball-engaging member. The ball-engaging member is formed of a yieldable material and is provided with a plurality of spaced apart flexible fingers. The opening defined between the fingers is slightly less than the cross-sectional size of the ball. By manipulating the flexible rod, the ball-engaging member may be vertically reciprocated towards and away from the post-supported ball. If accurately manipulated, the ball-engaging member during its downward movement may be caused to engage and grip the ball, and upon its subsequent upward movement will remove the ball from the post without causing the latter to fall.

3 Claims, 2 Drawing Figures

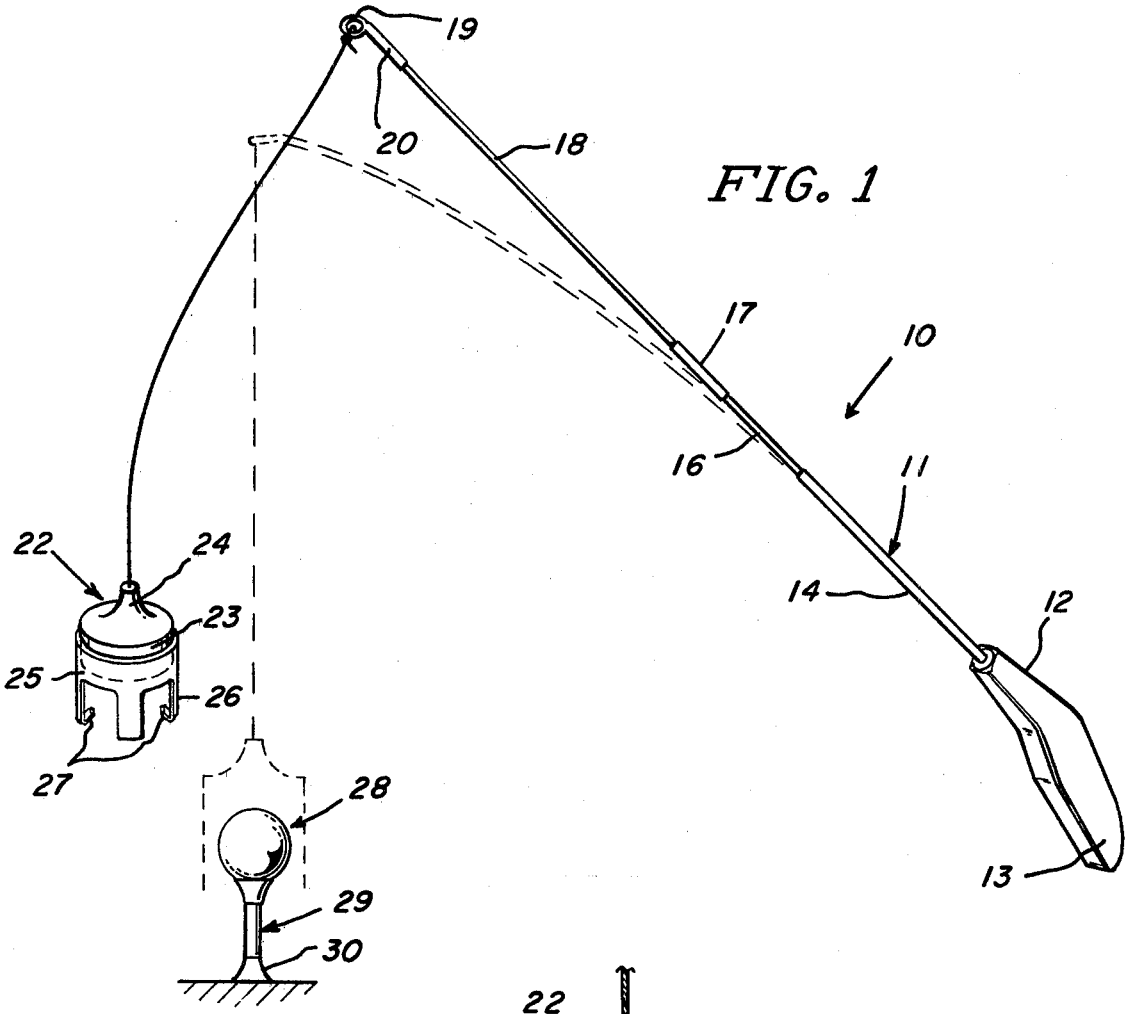
FIG. 1
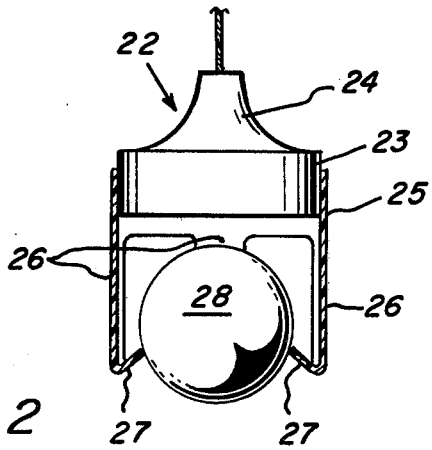
FIG. 2
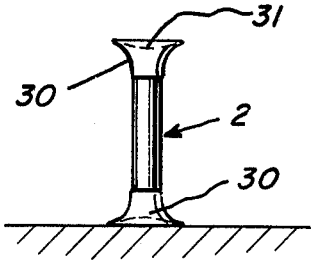

ROD SUPPORTED YIELDABLE BALL ENGAGING MEMBER FOR ENGAGING AND CLAMPING A POST SUPPORTED BALL

SUMMARY OF THE INVENTION

This invention relates to a toy, and more specifically to a toy used to play a game. It is an object of this invention to provide a toy or game device which may be used by both children and adults to play a game where the purpose is to remove a ball atop a post without upsetting the post. Accordingly, it is a specific object of this invention to provide a toy comprised of a ball which is supported upon a small, upright post. The toy also includes a flexible ball-engaging member attached to the end of a flexible line which in turn is connected to an elongate rod. In playing the game with the toy, the rod, if accurately manipulated will first cause the ball-engaging member to be urged downwardly toward the post-supported ball, and thereafter permit the ball-engaging member to grip and remove the ball from the post without causing the post to tip over.

These and other objects and advantages of this invention will more fully appear from the following description made in connection with the accompanying drawings, wherein like reference characters refer to the same or similar parts throughout the several views.

FIGURES OF THE DRAWINGS

FIG. 1 is a perspective view of the toy and

FIG. 2 is an elevational view of the toy, but illustrating the ball gripped by the ball-engaging member and removed from the post.

DESCRIPTION OF THE PREFERRED EMBODIMENTS

Referring now to the drawings, it will be seen that one embodiment of the toy or game device, designated generally by the reference numeral 10, is there shown. The toy 10 is comprised of an elongate, flexible sectional rod 11 which includes an elongate handle section 12. The handle section 12 includes an elongate handle portion 13 having a rod portion 14 integral therewith and extending longitudinally therefrom. The outer end of the rod portion is provided with a sleeve or coupling element 15.

The flexible sectional rod 11 also includes an elongate intermediate section 16 having a sleeve or coupling element 17 affixed to its outer end and projecting outwardly therefrom. The inner end portion of the intermediate section 16 projects telescopically into the sleeve 15 on the handle section. An elongate outer section 18 is telescopically received within the sleeve 17 of the intermediate section and projects longitudinally therefrom. The outer section 18 is provided with a sleeve 20 at its outer end, to which is affixed an eye 19. It is pointed out that the sections of the sectional rod may be formed of any suitable flexible material such as wood, fiberglass or the like so that the rod is dimensionally stable, but is capable of flexing in the manner of a fishing rod. It will be seen that the sectional rod may be quickly and easily assembled or disassembled as desired.

The outer section 18 of the sectional rod 11 has one end of an elongate flexible line 21 secured thereto, and the other end of the line 21 is secured to a ball-engaging member 22. The ball-engaging member 22 is comprised of a generally cylindrical body member 23 formed of a rigid material and having a generally frustro conical element projecting longitudinally from the upper end thereof. The flexible line 21 is secured to the upper end of the frustro conical element 24.

The lower end portion of the cylindrical body member 23 has a cylindrical element 25 secured thereto and projecting axially therefrom. The cylindrical element 25 is formed of a suitable yieldable material such as polypropylene or any other suitable flexible, yieldable or plastic material. The cylindrical element 25 has a plurality of elongate substantially flat, flexible fingers 26 integrally formed therewith and projecting axially and downwardly therefrom. The fingers 26, which are circumferentially spaced apart, are arranged in a cylindrical pattern and each terminates downwardly in a terminal portion 27 which is bent at an acute angle relative thereto and projects upwardly and inwardly therefrom. It will be appreciated that the fingers and terminal portions are yieldable and are capable of flexible movement.

The game device 10 also includes a lightweight rigid hollow ball 28 preferably of a size and weight corresponding to the conventional table tennis or Ping-Pong ball. The game device 10, further includes an elongate ball-supporting post or pylon 29. The ball-supporting post 29 is provided with a pair of end elements 30 which are also of frustro conical configuration and which flare outwardly, each terminating in enlarged concave end 31. The ball-supporting post 29 will be supported in upright fashion from a supporting surface by one end thereof, and the other concave end 31 of the post receives the ball 28 thereon. It is pointed out that the cross-sectional area of the ball 28 is slightly larger than the space defined between the inner ends of the terminal portions 27.

The object of the toy or game device 10 is to manipulate the ball-engaging member 22 by manipulating the sectional rod 11 to cause the ball-engaging member to engage and grip the ball 28 while it is supported on the post 29, and then to remove the ball from the post without upsetting the latter. Thus the ball 28 will be supported on the post 29 which in turn is supported in upright fashion from a supporting surface. A player, while holding the sectional rod 11 by the handle portion 13, vertically flexes the rod to vertically reciprocate the ball-engaging member 22. By accurately and expertly manipulating the rod and the ball-engaging member 22, the ball-engaging member may be urged downwardly in a reciprocating fashion so that the fingers and terminal portions engage the ball 28 and flex outwardly and thereafter grip the ball so that during the upward reciprocating movement of the ball-engaging member, the ball may be removed without tipping the post 29. It will be appreciated that since the space defined between the inturned ends of the terminal portions 27 are slightly less than the cross-sectional size of the bottle 28, the ball-engaging member must be correctly positioned when it is urged downwardly in order to avoid tipping the post over.

It will also be appreciated that accurate positioning of the ball-engaging member is necessary in order to prevent the ball-engaging member from merely striking the ball and impelling it from its supported position upon the post 29. The vertical reciprocating movement of the rod and ball-engaging member is similar to the jigging movement sometimes used in fishing. When a player fails to remove the ball from the post without upsetting the latter, he must surrender his turn to the next player who then attempts to remove the ball from the post.

It will therefore be seen that I have provided a novel toy or game device, which is of simple and inexpensive construction, but one which is uniquely constructed and adapted for use by both adults and children.

What is claimed is:

1. A toy comprising:

a spherical ball, an elongate ball support post adapted to have one end thereof engage a flat surface to extend vertically upwardly therefrom, and engaging and supporting said ball upon the other end thereof, an elongate flexible rod including a handle at one end thereof and having an outer end, an elongate flexible line having one end thereof secured to the outer end of said rod means for grasping said ball secured to the other end of said line and including a body having a plurality of elongate spaced apart flexible fingers extending longitudinally therefrom and arranged in a circular pattern, so that when said means is lowered, primarily by its own weight, over said ball supported on said post the fingers will be biased outwardly by said ball and be held in said means, said fingers terminating in inwardly projecting flexible terminal portions, the opening defined between the inwardly projecting end portions of said fingers, being slightly less than the cross-sectional size of said spherical ball.

2. A toy as defined in claim 1 wherein said rod is comprised of a plurality of sections, including an elongate handle section and elongate outer section, and means detachably connecting said handle section and said outer section together.

3. The toy as defined in claim 2 wherein said means detachably connecting said handle section and outer section together includes an intermediate section detachably connected to said handle section and outer section.

* * * * *